US008810496B2

(12) United States Patent
Park et al.

(10) Patent No.: US 8,810,496 B2
(45) **Date of Patent: *Aug. 19, 2014**

(54) LIQUID CRYSTAL DISPLAY AND METHOD OF DRIVING THE SAME

(71) Applicant: Samsung Display Co., Ltd., Yongin (KR)

(72) Inventors: Bong-Im Park, Asan-si (KR); Kang-Hyun Kim, Seoul (KR); Jong-Hyon Park, Cheonan-si (KR); Woo-Chul Kim, Seoul (KR); Yun-Jae Kim, Asan-si (KR); Jae-Won Jeong, Seoul (KR); Bong-Ju Jun, Cheonan-si (KR); Yong-Jun Choi, Cheonan-si (KR); Woo-Young Lee, Daegu (KR)

(73) Assignee: Samsung Display Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/165,037

(22) Filed: Jan. 27, 2014

(65) Prior Publication Data

US 2014/0139563 A1 May 22, 2014

Related U.S. Application Data

(63) Continuation of application No. 12/503,454, filed on Jul. 15, 2009, now Pat. No. 8,674,922.

(30) Foreign Application Priority Data

Dec. 24, 2008 (KR) ..... 10-2008-0133745

(51) Int. Cl.
*G09G 3/36* (2006.01)
*G09G 3/20* (2006.01)

(52) U.S. Cl.
CPC ..... *G09G 3/3648* (2013.01); *G09G 3/2003* (2013.01); *G09G 2320/0252* (2013.01); *G09G 2320/0261* (2013.01); *G09G 3/3607* (2013.01); *G09G 2340/16* (2013.01)
USPC ..... 345/98; 345/100; 345/690

(58) Field of Classification Search
CPC ..... G09G 3/3648; G09G 3/3688; G09G 2340/16; G09G 3/3611; G09G 3/3696; G09G 3/3291; G09G 3/2022; G09G 3/3655; G09G 3/3266; G09G 3/3406; G09G 3/3659; G09G 2320/0626; G09G 3/3622; G09G 2320/0686; G09G 2360/147; G09G 3/006; G09G 3/2003; G09G 3/2011; G09G 3/2025; G09G 3/3216
USPC ..... 345/87–102
See application file for complete search history.

(56) References Cited

U.S. PATENT DOCUMENTS

| | | | |
|---|---|---|---|
| 8,031,147 | B2 | 10/2011 | Jeon et al. |
| 8,049,691 | B2 | 11/2011 | Pan et al. |
| 8,284,140 | B2 | 10/2012 | Jeon et al. |
| 8,564,521 | B2 | 10/2013 | Cho |
| 2004/0196274 | A1 | 10/2004 | Song et al. |
| 2005/0068343 | A1 | 3/2005 | Pan et al. |
| 2007/0195041 | A1 | 8/2007 | Lee |
| 2007/0195046 | A1 | 8/2007 | Cho |
| 2007/0296669 | A1 | 12/2007 | Jeon et al. |
| 2011/0316900 | A1 | 12/2011 | Jeon et al. |

FOREIGN PATENT DOCUMENTS

| | | | |
|---|---|---|---|
| EP | 1521237 | A3 | 4/2005 |
| JP | 2004302460 | A | 10/2004 |
| JP | 2005107531 | A | 4/2005 |
| JP | 2007219474 | A | 8/2007 |
| JP | 2008009434 | A | 1/2008 |
| JP | 2008039816 | A | 2/2008 |
| KR | 1020060120899 | A | 11/2006 |
| WO | 2007108436 | A1 | 9/2007 |

OTHER PUBLICATIONS

Lee, et al, "TFT-LCD with Sub-10 ms of All Gray Response Time: Dynamic Capacitance Compensation"; IDW, AMD4-5 (Late-News Paper), 2000, pp. 1153-1154.

Extended European Search Report for Application No. 09011359.8-1228/2202719 dated Jul. 22, 2010.

Kobayashi, et al, "Feedback Level-Adaptive Overdrive (FB-LAO) Method for Multi-Media LCDs", IDW, 2002, pp. 323-326.

*Primary Examiner* — Duc Dinh
(74) *Attorney, Agent, or Firm* — Cantor Colburn LLP

(57) ABSTRACT

A liquid crystal display includes a timing controller and a liquid crystal panel. The timing controller sequentially receives first through third primitive image signals and sequentially outputs first through third corrected image signals. The liquid crystal panel displays an image based on the first through third corrected image signals. The timing controller generates a first converted image signal having a first gray level based on the first primitive image signal and stores the first converted image signal. The second primitive image signal has a second gray level and the timing controller generates a second converted image signal having a third gray level higher than the second gray level when the second gray level is lower than the first gray level. The timing controller generates the third corrected image signal using the second converted image signal and the third primitive image signal.

20 Claims, 12 Drawing Sheets

FIG. 10

| G4 \ G8 | 0 | 8 | 16 | 24 | 32 | 40 | 48 | 56 | 64 | 72 | 80 | 88 | 96 | 104 | 112 | 120 | 128 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 0 | 2 | 3 | 4 | 4 | 5 | 6 | 6 | 7 | 7 | 7 | 8 | 14 | 63 | 92 | 112 | 116 |
| 32 | 0 | 4 | 13 | 14 | 14 | 14 | 14 | 14 | 14 | 15 | 15 | 16 | 24 | 64 | 89 | 105 | 112 |
| 48 | 0 | 7 | 17 | 20 | 23 | 23 | 25 | 25 | 25 | 26 | 26 | 26 | 29 | 60 | 85 | 97 | 100 |
| 64 | 0 | 9 | 17 | 20 | 22 | 24 | 26 | 28 | 30 | 31 | 33 | 35 | 39 | 58 | 75 | 87 | 91 |
| 80 | 0 | 9 | 18 | 21 | 23 | 24 | 26 | 29 | 30 | 32 | 35 | 39 | 48 | 48 | 52 | 57 | 61 |
| 96 | 0 | 10 | 18 | 21 | 23 | 25 | 27 | 30 | 33 | 36 | 40 | 45 | 53 | 63 | 74 | 85 | 97 |
| 112 | 0 | 10 | 18 | 23 | 26 | 29 | 33 | 38 | 44 | 50 | 58 | 67 | 82 | 99 | 107 | 114 | 118 |
| 128 | 8 | 11 | 19 | 24 | 32 | 40 | 48 | 56 | 64 | 72 | 80 | 88 | 96 | 104 | 112 | 120 | 124 |
| 144 | 11 | 11 | 19 | 31 | 46 | 60 | 70 | 77 | 83 | 87 | 92 | 97 | 102 | 108 | 115 | 124 | 127 |
| 160 | 13 | 13 | 23 | 39 | 56 | 71 | 80 | 84 | 87 | 89 | 92 | 96 | 104 | 109 | 116 | 125 | 129 |
| 176 | 13 | 13 | 24 | 42 | 60 | 75 | 83 | 86 | 88 | 90 | 92 | 95 | 103 | 108 | 117 | 126 | 129 |
| 192 | 24 | 24 | 26 | 42 | 56 | 73 | 83 | 86 | 88 | 90 | 92 | 96 | 106 | 110 | 117 | 127 | 130 |
| 208 | 31 | 31 | 36 | 48 | 63 | 76 | 85 | 89 | 91 | 93 | 95 | 99 | 107 | 109 | 116 | 127 | 131 |
| 224 | 32 | 32 | 34 | 45 | 61 | 77 | 86 | 89 | 91 | 92 | 93 | 96 | 101 | 106 | 116 | 128 | 131 |
| 240 | 32 | 32 | 34 | 38 | 47 | 72 | 84 | 86 | 88 | 89 | 90 | 92 | 96 | 110 | 118 | 133 | 136 |
| 255 | 255 | 255 | 255 | 255 | 255 | 255 | 255 | 255 | 255 | 255 | 255 | 255 | 255 | 255 | 255 | 255 | 255 |

LIQUID CRYSTAL DISPLAY AND METHOD OF DRIVING THE SAME

This application is a continuation of U.S. patent application Ser. No. 12/503,454, filed on Jul. 15, 2009, which claims priority to Korean Patent Application No. 10-2008-0133745, filed on Dec. 24, 2008, and all the benefits accruing therefrom under 35 U.S.C. §119, the contents of which in its entirety are herein incorporated by reference.

BACKGROUND OF THE INVENTION

1. Field of the Invention

The present invention relates to a liquid crystal display ("LCD") and a method of driving the LCD and, more particularly, to an LCD having a substantially improved response speed of a liquid crystal layer therein, and a method of driving the LCD.

2. Description of the Related Art

A liquid crystal display ("LCD") generally includes a first display panel having pixel electrodes, a second display panel having a common electrode and a liquid crystal layer interposed between the first display panel and the second display panel. The liquid crystal layer has a dielectric anisotropy. The LCD typically further includes a gate driving module which drives gate lines, a data driving module which outputs a data signal, and a timing controller which controls the gate driving module and the data driving module.

When an image signal is supplied to the LCD from an external graphic source, for example, the image signal is transmitted to a liquid crystal panel of the LCD via the timing controller. In addition, the timing controller corrects primitive image signal using a dynamic capacitance compensation ("DCC") method and/or an adapted color correction ("ACC") method, for example, to improve a response speed of the liquid crystal layer.

BRIEF SUMMARY OF THE INVENTION

Exemplary embodiments of the present invention provide a liquid crystal display ("LCD") having substantially improved display quality.

Exemplary embodiments of the present invention also provide a method of driving the LCD having substantially improved display quality.

According to an exemplary embodiment, a liquid crystal display ("LCD") includes a timing controller and a liquid crystal panel. The timing controller sequentially receives a first primitive image signal, a second primitive image signal and a third primitive image signal and sequentially outputs a first corrected image signal, a second corrected image signal and a third corrected image signal. The liquid crystal panel displays an image based on the first corrected image signal, the second corrected image signal and the third corrected image signal. The timing controller generates a first converted image signal having a first gray level based on the first primitive image signal and stores the first converted image signal. The second primitive image signal has a second gray level, and the timing controller generates a second converted image signal having a third gray level higher than the second gray level when the second gray level is lower than the first gray level.

According to an exemplary embodiment, a method of driving an LCD includes sequentially receiving a first primitive image signal, a second primitive image signal and a third primitive image signal, sequentially outputting a first corrected image signal, a second corrected image signal and a third corrected image signal, and displaying an image based on the first corrected image signal, the second corrected image signal and the third corrected image signal. The sequentially outputting the first corrected image signal, the second corrected image signal and the third corrected image signal includes generating a first converted image signal having a first gray level based on the first primitive image signal, storing the first converted image signal, generating, when the second primitive image signal has a second gray level lower than the first gray level, a second converted image signal having a third gray level higher than the second gray level based on the second primitive image signal, generating the third corrected image signal using the second converted image signal and the third primitive image signal, and outputting the third corrected image signal.

BRIEF DESCRIPTION OF THE DRAWINGS

The above and other aspects, features and advantages of the present invention will become more readily apparent by describing in further detail exemplary embodiments thereof with reference to the accompanying drawings, in which:

FIG. 10 is an exemplary embodiment of a lookup table utilized by a first signal compensator of the timing controller shown in FIG. 8;

DETAILED DESCRIPTION OF THE INVENTION

Figure 1:
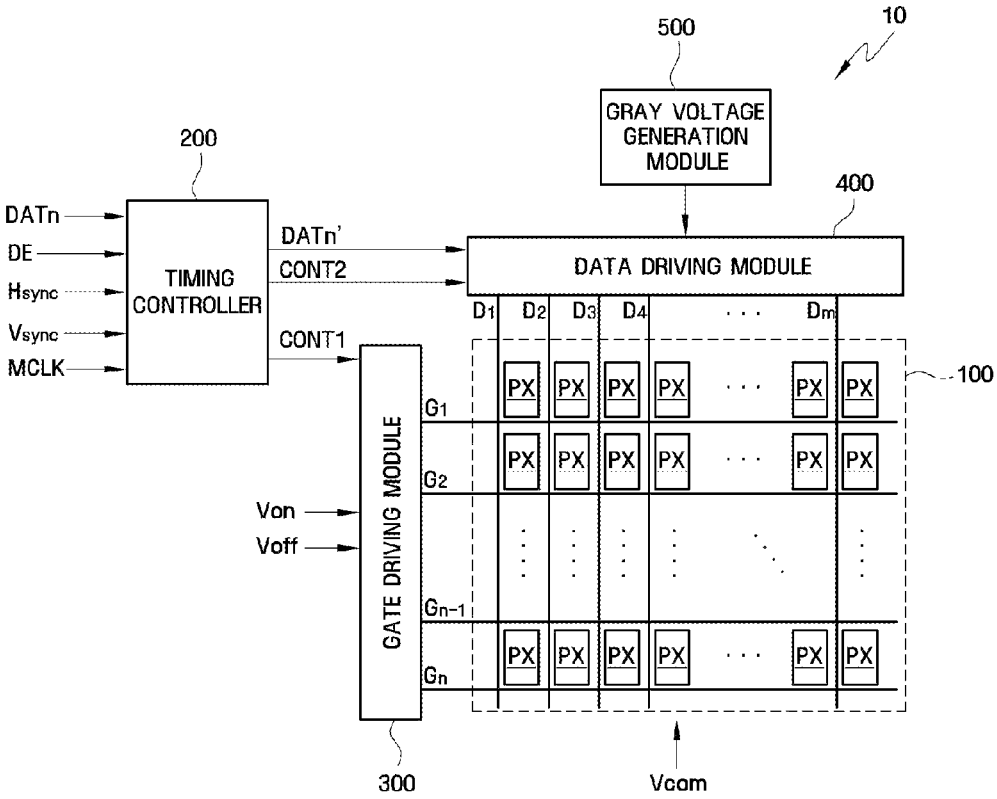
FIG. 1 is a block diagram of an exemplary embodiment of a liquid crystal display ("LCD") according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," When used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

A liquid crystal display ("LCD") and a method of driving the LCD according to exemplary embodiments will hereinafter be described in further detail with reference to FIGS. 1 through 4.

Figure 2:
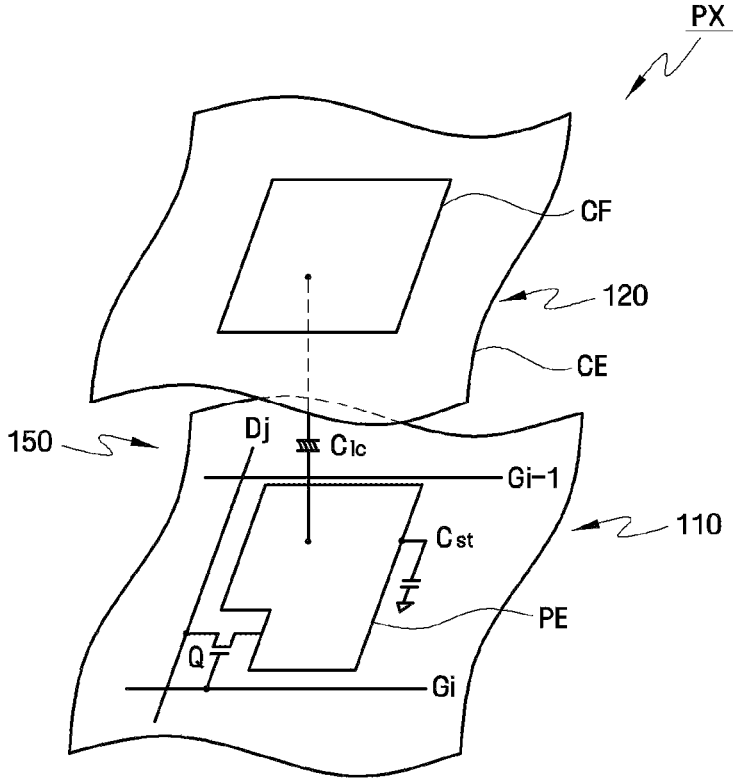
FIG. 2 is an equivalent circuit diagram of a pixel of the LCD shown in FIG. 1.
Figure 3:
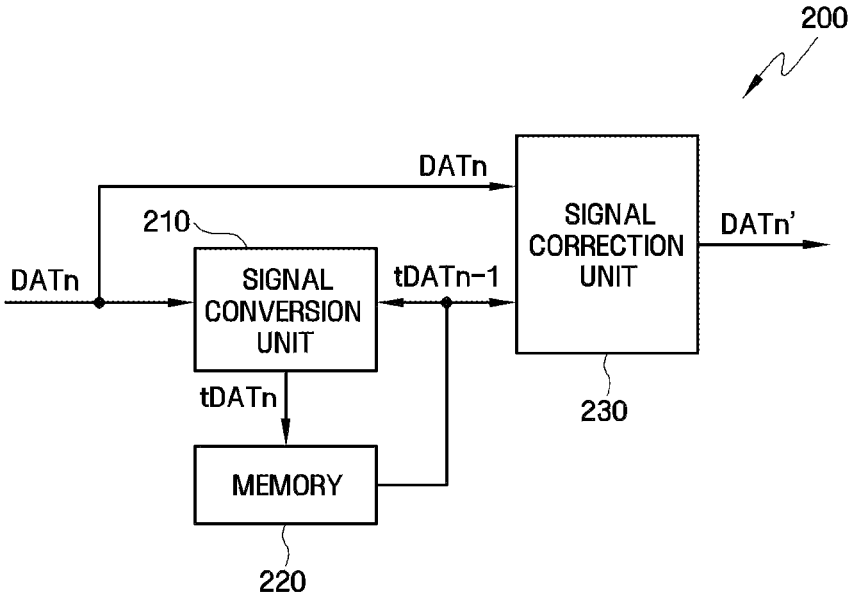
FIG. 3 is a block diagram of an exemplary embodiment of a timing controller of the LCD shown in FIG. 1.
Figure 4:
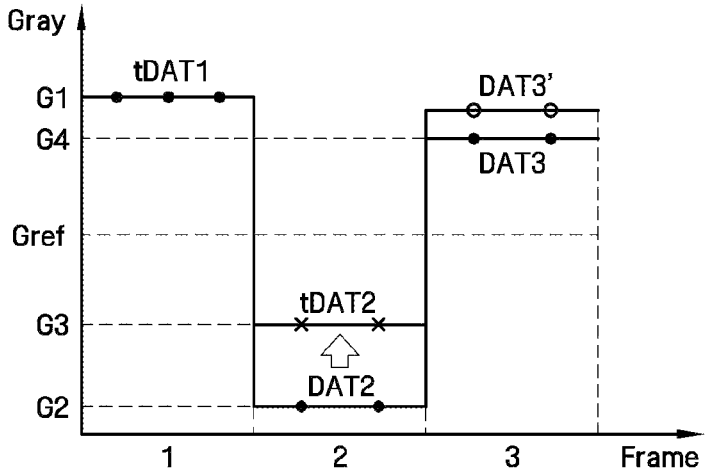
FIG. 4 is a signal timing diagram which illustrates an exemplary embodiment of an operation of the timing controller shown in FIG. 3.

FIG. 1 is a block diagram of an exemplary embodiment of an LCD 10 according to the present invention, FIG. 2 is an equivalent circuit diagram of a pixel PX of the LCD 10, FIG. 3 is a block diagram of a timing controller 200 of the LCD 10 shown in FIG. 1, and FIG. 4 is a signal timing diagram for explaining an exemplary embodiment of an operation of the timing controller 200.

Referring to FIG. 1, the LCD 10 according to an exemplary embodiment includes a liquid crystal panel 100, a gate driving module 300, a data driving module 400 and the timing controller 200.

The liquid crystal panel 100 is connected to display signal lines and includes pixels PX arranged in a substantially matrix pattern. Referring to FIG. 2, the liquid crystal panel 100 includes a first display panel 110 and a second display panel 120 facing the first display panel 110 and a liquid crystal layer 150 interposed between the first display panel 110 and the second display panel 120.

The display signal lines may include gate lines $G_1$ through $G_n$ which transmit a gate signal and data lines $D_1$ through $D_m$ which transmit a data signal. The gate lines $G_1$ through $G_n$ extend in a substantially row direction, and in parallel with one another. The data lines $D_1$ through $D_m$ extend in a substantially column direction, and in parallel with one another.

Referring to FIG. 2, a pixel electrode PE may be disposed on the first display panel 110, and a common electrode CE may be disposed on the second display panel 120. A color filter CF may be disposed on a portion of the common electrode CE to face the pixel electrode PE. An i-th (where i=1-n) pixel PX, which is connected to an i-th gate line Gi and a j-th data line Dj (where j=1-m), may include a switching device Q connected to the i-th gate line Gi and the j-th data line Dj, a liquid crystal capacitor Clc connected to the switching device Q and a storage capacitor Cst connected to the switching device Q.

Referring to FIG. 1, the timing controller 200 receives a current primitive image signal DATn corresponding to a current frame, and external clock signals for controlling display of the current primitive image signal DATn. IN an exemplary embodiment, the current primitive image signal DATn may include red signals R, green signals G and blue signals B. The external clock signals may include a data enable signal DE, a vertical synchronization signal Vsync, a horizontal synchronization signal Hsync and a main clock signal MCLK. The data enable signal DE maintains a high level during the receipt of the current primitive image signal DATn and may thus indicate that a signal currently being provided by an external graphic controller (not shown) is the current primitive image signal DATn. The vertical synchronization signal Vsync may be a signal indicating a beginning point of a frame. The horizontal synchronization signal Hsync may be a signal for distinguishing the gate lines $G_1$ through $G_n$ from one another. The main clock signal Mclk may be a clock signal from which a synchronization of other signals of the LCD 10 is based.

The timing controller 200 generates a gate control signal CONT1 and a data control signal CONT2 based on the external clock signals, transmits the gate control signal CONT1 to the gate driving module 300 and the data control signal CONT2 to the data driving module 400.

The timing controller 200 may generate a corrected image signal DATn' by correcting the current primitive image signal DATn, and may output the corrected image signal DATn'. The timing controller 200 according to an exemplary embodiment sequentially receives a first primitive image signal, a second primitive image signal and a third primitive image signal and sequentially outputs a first corrected image signal, a second corrected image signal and a third corrected image signal. The timing controller 200 generates a first converted image signal having a first gray level based on the first primitive image signal, and stores the first converted image signal. When a second gray level corresponding to the second primitive image signal is lower than the first gray level, the timing controller 200 generates a second converted image signal having a third gray level higher than the second gray level based on the second primitive image signal. The timing controller 200 generates the third corrected image signal based on the second converted image signal and the third primitive image signal. Generation of the abovementioned signals will be described in further detail below with reference to FIGS. 3 and 4.

Referring still to FIGS. 1 and 2, the gate driving module 300 receives the gate control signal CONT1 from the timing controller 200 and sequentially applies gate signals to the gate lines $G_1$ through $G_n$. The gate control signal CONT1, which is a signal for controlling an operation of the gate driving module 300, includes a vertical initiation signal STV for initiating operation of the gate driving module 300, a gate clock signal CPV for determining when to output a gate-on voltage Von, and an output enable signal OE for determining a pulse width of the gate-on voltage Von. The gate signal applied to the gate lines $G_1$ through $G_n$ may be the combination of the gate-on voltage and a gate-off voltage Voff, which are provided by an external gate on/off voltage generator (not shown).

The data driving module 400 receives the data control signal CONT2 and the corrected image signal DATn' from the timing controller 200 and applies an image data voltage to the data lines $D_1$ through $D_{111}$. The data control signal CONT2, which is a signal for controlling an operation of the data driving module 400, includes a horizontal initiation signal STH for initiating the operation of the data driving module 400 and an output instruction signal TP for providing instructions to output the image data voltage. The image data voltage may be a gray voltage corresponding to the corrected image signal DATn' and may be generated based on a gray voltage provided by a gray voltage generation module 500.

The gray voltage generation module 500 may include a plurality of resistors connected in series between a ground source and a node to which a driving voltage is applied, and may generate gray voltages by dividing the driving voltage. However, a structure of the gray voltage generation module 500 is not restricted to the configuration described herein.

An operation of the timing controller 200 will now be described in further detail with reference to FIGS. 3 and 4.

Referring to FIG. 3, the timing controller 200 may include a signal conversion unit 210, a memory 220 and a signal correction unit 230.

The timing controller 200 sequentially receives the first primitive image signal, the second primitive image signal and the third primitive image signal and sequentially outputs the first corrected image signal, the second corrected image signal and the third corrected image signal. The timing controller 200 generates a first converted image signal having a first gray level based on the first primitive image signal, and stores the first converted image signal. When a second gray level corresponding to the second primitive image signal is lower than the first gray level, the timing controller 200 generates a second converted image signal having a third gray level, which is higher than the second gray level, based on the second primitive image signal. The timing controller 200 generates the third corrected image signal based on the second converted image signal and the third primitive image signal.

The first primitive image signal, the second primitive image signal and the third primitive image signal correspond to images displayed on the liquid crystal panel 100 during a first frame, a second frame and a third frame, respectively. For example, when the third primitive image signal is the current primitive image signal DATn corresponding to a current frame, e.g., an nth frame, the second primitive image signal is a previous primitive image signal DATn−1 corresponding to a previous frame, e.g., an (n−1)th frame, and the first primitive image signal may be a second previous primitive image signal DATn−2 corresponding to a second previous frame, e.g., an (n−2)th frame.

The signal correction unit 230 generates a corrected image signal DATn' by correcting the current primitive image signal DATn using a previous converted image signal tDATn−1 corresponding to the previous frame, e.g., the (n−1)th frame, and outputs a corrected image signal DATn'. The previous converted image signal tDATn−1 is provided by the memory 220, where it is store. The corrected image signal DATn' is transmitted to the liquid crystal panel 100, and thus, an image corresponding to the corrected image signal DATn' is displayed on the liquid crystal panel 100. In an exemplary embodiment, the signal correction unit 230 performs dynamic capacitance compensation ("DCC") to substantially improve a response speed of liquid crystal molecules in the liquid crystal panel 100. The signal correction unit 230 may include a lookup table showing a correspondence between a gray level of the current primitive image signal DATn, a gray level of the previous converted image signal tDATn−1 and a gray level of the corrected image signal DATn'. For example, when the gray level of the primitive image single DATn is "a" and the gray level of the previous converted image signal tDATn−1 is "b", the signal correction unit 230 may search the lookup table for a gray level corresponding to a gray level pair including the gray levels a and b to determine an identified gray level as the gray level of the corrected image signal DATn'. However, the lookup table is not limited to as described above in exemplary embodiments. The lookup table according to exemplary embodiments may be modified in various ways, according to a purpose or intended use of the LCD 10.

The signal conversion unit 210 receives the current primitive image signal DATn, converts the current primitive image signal DATn into a current converted image signal tDATn corresponding to the current frame, e.g., the nth frame, and outputs the current converted image signal tDATn. The signal conversion unit 210 converts the current primitive image signal DATn into the current converted image signal tDATn based on the previous converted image signal tDATn−1 provided from the memory 220. The current converted image signal tDATn generated by the signal conversion unit 210 is stored in the memory 220 for one frame, for example, and may then be provided to the signal conversion unit 210.

Thus, in an exemplary embodiment, the signal conversion unit 210 receives a first primitive image signal and generates and stores a first converted image signal corresponding to the first primitive image signal. Thereafter, the signal conversion unit 210 receives a second primitive image signal, generates a second converted image signal based on the first converted image signal and the second primitive image signal, and stores the second converted image signal. Thereafter, the signal conversion unit 210 receives a third primitive image signal and generates a third corrected image signal based on the second converted image signal and the third primitive image signal.

In an exemplary embodiment, the signal conversion unit 210 may convert only some primitive image signals into converted image signals. For example, when a second gray level corresponding to the current primitive image signal DATn is less than a first gray level corresponding to the previous converted image signal tDATn−1, the signal conversion unit 210 may covert the current primitive image signal DATn into the conversion image tDATn. When the second gray level is lower than a reference gray level and the first gray level is higher than the reference gray level, the signal conversion unit 210 may covert the current primitive image signal DATn into the conversion image tDATn.

Thus, when the primitive image signal rapidly varies from a high gray level to a relatively low gray level, the signal correction unit 230 corrects the current primitive image signal DATn using the previous converted image signal tDATn−1, and thus a display quality according to an exemplary embodiment is substantially improved.

The signal conversion unit 210 according to an exemplary embodiment generates the current converted image signal tDATn using a lookup table, for example. The lookup table may include various gray levels for an image signal pair having the previous converted image signal tDATn−1 and the current primitive image signal DATn. The gray levels included in the lookup table may be experimental values obtained by displaying an image corresponding to the previous converted image signal tDATn−1 on the liquid crystal panel 100, applying the current primitive image signal DATn to the liquid crystal panel 100 and then measuring the gray level of the liquid crystal panel 100 for one frame. In an exemplary embodiments, however, the gray levels included in the lookup table may be modified in various manners according to properties of the LCD 10. Therefore, the signal conversion unit 210 may determine a gray level corresponding to the image signal pair including the previous converted image signal tDATn−1 and the current primitive image signal DATn with reference to the lookup table and thus outputs the determined gray level as the current converted image signal tDATn.

The memory 220 receives the current converted image signal tDATn from the signal conversion unit 210, stores the current converted image signal tDATn for one frame, for example, and outputs the current converted image signal tDATn to the signal conversion unit 210 and the signal correction unit 230 as another previous converted image signal. The previous converted image signal tDATn−1 in the memory 220 is a signal generated based on a second previous converted image signal corresponding to the second previous frame, e.g., the (n−2)th frame, and a previous primitive image signal corresponding to the previous frame, e.g., the (n−1)th frame, and may thus include information regarding the second previous converted image signal. Therefore, the LCD 10 is able to correct an image signal based on three image signals respectively corresponding to three consecutive frames using a storage capacity corresponding to storage of an image signal corresponding to only a single frame.

An operation of the timing controller 200 according to an exemplary embodiment will now be described in further detail with reference to FIG. 4. For purposes of convenience, it will hereinafter be assumed that the first primitive image signal DAT1, the second primitive image signal DAT2 and the third primitive image signal DAT3 correspond to three consecutive frames, e.g., a first frame through a third frame, which are consecutively provided. However, it will be noted that exemplary embodiments are not restricted to the above-mentioned assumption.

During the third frame, the signal correction unit 230 generates a third corrected image signal DAT3' based on the third primitive image signal DAT3. The third corrected image signal DAT3' is generated based on a second converted image signal tDAT2 and the third primitive image signal DAT3. As described in greater detail above, the signal correction unit 230 generates the third corrected image signal DAT3' using a lookup table including gray levels for an image signal pair including the second converted image signal tDAT2 and the third primitive image signal DAT3. The gray levels included in the lookup table may be DCC values, but exemplary embodiments are not limited thereto.

During the second frame, the signal corrector 210 generates the second converted image signal tDAT2 based on the second primitive image signal DAT2. The second converted image signal tDAT2 is generated based on a first converted image signal tDAT1 stored in the memory 220 and the second primitive image signal DAT2. As described in further detail above, the signal correction unit 230 generates the second corrected image signal DAT2' by using a lookup table including gray levels for an image signal pair including the first converted image signal tDAT1 and the second primitive image signal DAT2.

In an exemplary embodiment, a second gray level G2 corresponding to the second primitive image signal DAT2 is lower than a first gray level G1 corresponding to the first converted image signal tDAT1. When the second gray level G2 is lower than the first gray level G1, the second converted image signal tDAT2 having a third gray level G3 is generated based on the second primitive image signal DAT2. The third gray level G3 is higher than the second gray level G2. In addition, the third gray level G3 may be lower than a fourth gray level G4 corresponding to the third primitive image signal DAT3.

The first gray level G1 is higher than a reference gray level Gref, and the second gray level G2 is lower than the reference gray level Gref. Thus, the first gray level G1 is a relatively high gray level, and the second gray level G2 is a relatively low gray level. The fourth gray level G4 is higher than the second gray level G2. Thus, when the first primitive image signal DAT2, the second primitive image signal DAT2 and the third primitive image signal DAT3 involve fluctuations from a relatively high gray level to a relatively low gray level and/or from the relatively low gray level to the relatively high gray level, a display quality of an image displayed on the liquid crystal panel 100 according to an exemplary embodiment is substantially improved by increasing the gray level of the second primitive image signal DAT2 from the second gray level G2 to the third gray level G3.

More particularly, when the gray level of the second primitive image signal DAT2 is less than a gray level of the first converted image signal tDAT1, e.g., when the first converted image signal tDAT1 has a relatively high gray level and the second primitive image signal DAT2 has a relatively low gray level, the LCD 10 according to an exemplary embodiment generates the second converted image signal tDAT2 corresponding to the second primitive image signal DAT2 with reference to a lookup table, stores the second converted image signal tDAT2 in the memory 220, generates the third corrected image signal DAT3' based on the third primitive image signal DAT3 and the second converted image signal tDAT2 and displays an image corresponding to the third corrected image signal DAT3' on the liquid crystal panel 100.

According to an exemplary embodiment shown in FIGS. 1 through 4, when there are fluctuations from a relatively high gray level to a relatively low gray level and then from the relatively low gray level to another relatively high gray level, a display quality of an image is substantially improved by converting an image signal corresponding to the relatively low gray level into a converted image signal having a relatively higher gray level than the relatively low gray level based on a response speed of liquid crystal molecules.

Figure 5:
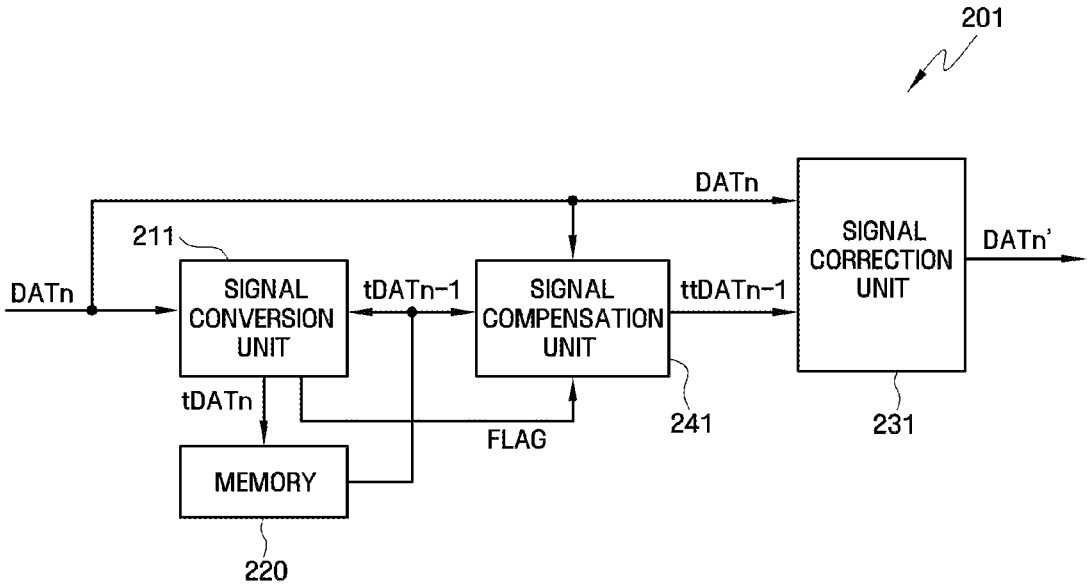
FIG. 5 is a block diagram of an exemplary embodiment of a timing controller of an LCD according to the present invention.

An LCD and a method of driving the LCD according to an exemplary embodiment, will now be described in detail with reference to FIGS. 5 through 7. FIG. 5 is a block diagram of an exemplary embodiment of a timing controller 201 of an LCD according to the present invention, FIG. 6 is a signal timing diagram for explaining an exemplary embodiment of an operation of the timing controller 201, and FIG. 7 is a graph of gray level versus reference gray level for explaining an exemplary embodiment of an operation of a signal conversion unit 211 of the timing controller 201 shown in FIG. 5.

Figure 6:
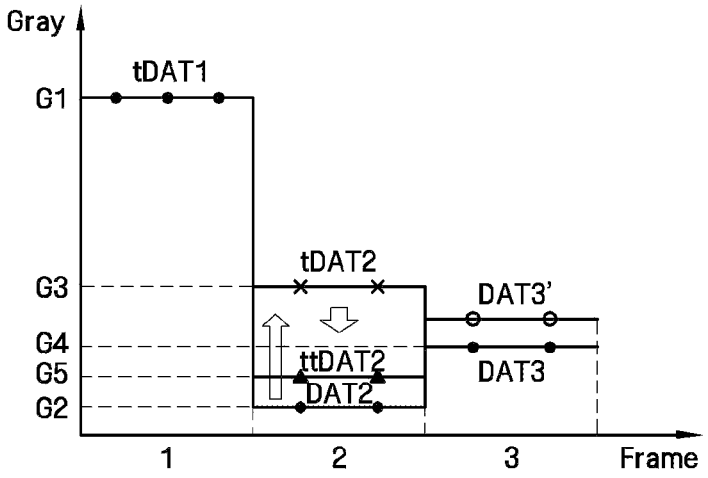
FIG. 6 is a signal timing diagram which illustrates an exemplary embodiment of an operation of the timing controller shown in FIG. 5.
Figure 7:
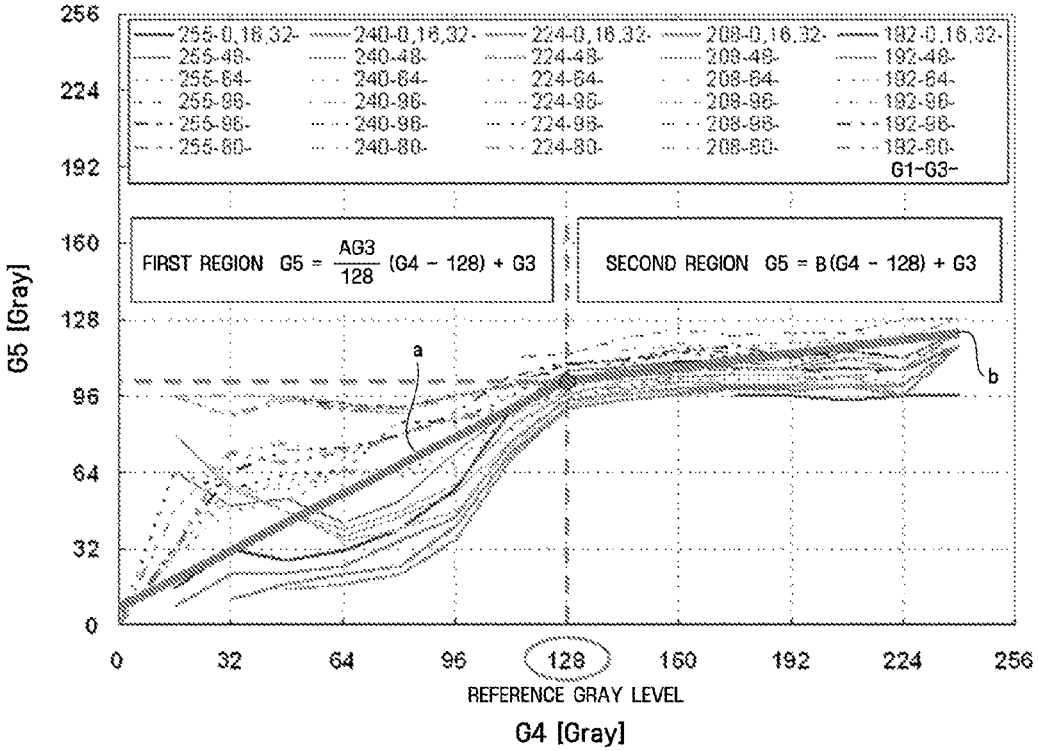
FIG. 7 is a graph of gray level versus reference gray level illustrating an exemplary embodiment of an operation of a signal conversion unit of the timing controller shown in FIG. 5.

Referring to FIGS. 5 and 6, the timing controller 201 according to an exemplary embodiment includes signal conversion unit 211, a memory 220, a signal compensation unit 241 and a signal correction unit 231.

The signal conversion unit 211 generates a current converted image signal tDATn corresponding to a current frame, e.g., a nth frame, using a gray level corresponding to an image signal pair including a current primitive image signal DATn corresponding to the current frame, e.g., the nth frame, and a previous converted image signal tDATn−1 corresponding to a previous frame, e.g., a (n−1)th frame. The current primitive image signal DATn may be provided by an external source (not shown), and the previous converted image signal tDATn−1 may be provided by the memory 220. The current converted image signal tDATn is stored in the memory 220 for one frame, for example, and is then be transmitted to the signal conversion unit 211 and the signal compensation unit 231 as another previous converted image signal.

When a second gray level G2 corresponding to the current primitive image signal DATn is lower than a first gray level G1 corresponding to the previous converted image signal tDATn−1, the signal conversion unit 211 converts the current primitive image signal into the current converted image signal tDATn having a third gray level G3 higher than the second gray level G2. In this case, the signal conversion unit 211 transmits a signal such as a conversion flag signal FLAG, for example, indicating that the current primitive image signal DATn has been converted into the current converted image signal tDATn to the signal compensation unit 241, and thus allows the signal compensation unit 241 to determine whether to compensate for the current converted image signal tDATn. When the current primitive signal DATn is converted into the current converted image signal tDATn, the conversion flag signal FLAG is placed in an on-state, and is then transmitted to the signal compensation unit 241, but exemplary embodiments are not limited to the foregoing configuration.

The signal compensation unit 241 receives the previous converted image signal tDATn−1 from the memory 220 in response to the conversion flag signal FLAG, and generates a previous compensated image signal ttDATn−1 corresponding to the previous frame based on the current primitive image signal DATn. When a fourth gray level corresponding to the current primitive image signal DATn is lower than the third gray level G3, the signal compensation unit 241 generates the previous compensated image signal ttDATn−1 having a fifth gray level G5 lower than the third gray level G3.

Referring to FIG. 6, the signal compensation unit 241 compares gray level of a first converted image signal tDAT1, e.g., the first gray level G1, and a gray level of a second primitive image signal DAT2, e.g., the second gray level G2, convert the second primitive image signal DAT2 into a second converted image signal tDAT2 having the third gray level G3 based on a result of the comparison. Thereafter, the signal compensation unit 241 may generate a second compensated image signal ttDAT2 having the fifth gray level G5 by compensating for the second converted image signal tDAT2 based on a gray level of a third primitive image signal DAT3, e.g., the fourth gray level G4. Thereafter, the signal compensation unit 241 may generate a third corrected image signal DAT3' by correcting the third primitive image signal DAT3 based on the second corrected image signal ttDAT2.

The signal compensation unit 241 applies different compensation methods to the second converted image signal tDAT2 based on whether the fourth gray level G4 is higher than or lower than a reference gray level Gref.

The signal compensation unit 241 chooses one of two or more formulae, as shown in FIG. 7, with reference to the fourth gray level G4 and generate the second compensated image signal ttDAT2 by applying the chosen compensation formula to the second converted image signal tDAT2. FIG. 7 illustrates a graph illustrating how to experimentally determine a gray level of the second compensated image signal ttDAT2, e.g., the fifth gray level G5, based on the third primitive image signal DAT3 having the fourth gray level G4 and the second converted image signal tDAT2 having the third gray level G3. More particularly, FIG. 7 illustrates a graph showing a relationship between the fourth gray level G4 and the fifth gray level G5 when the first gray level G1 is 255, for example, and the third gray level G3 is 0, 16 or 32, for example. Referring to the graph shown in FIG. 7, curves therein represent relationships between the fourth gray level G4 and the fifth gray level G5 for combinations of 16 gray levels selected from 256 gray levels ranging from 0 to 255.

The graph shown in FIG. 7 may be divided in halves at a gray level of 128, e.g., may be divided into a first region and a second region having different dispersion slopes. A primary expression with a slope A may be determined from a plurality of curves (a) in the first region, and a primary expression with a slope B may be determined from a plurality of curves (b) in the second region. When the reference gray level Gref is 128 and the fourth gray level is lower than the reference gray level Gref (128, for example) and is thus in the first region, the second compensated image signal ttDAT2 is generated by applying Compensation Formula (1) to the second converted image signal tDAT2. When the fourth gray level is higher than the reference gray level (128, for example) and is thus in the second region, the second compensated image signal ttDAT2 is generated by applying Compensation Formula (2) to the second converted image signal tDAT2. Compensation Formulae (1) and (2) are as follows:

$$G5 = \frac{AG3}{128}(G4 - 128) + G3; \qquad \text{Compensation Formula (1)}$$

and $$G5 = B(G4 - 128) + G3. \qquad \text{Compensation Formula (2)}$$

However, the setting of the reference gray level Gref and the compensation formulae used to generate the second compensated image signal ttDAT2 are not restricted to those set forth herein, and exemplary embodiments may utilize different methods thereof.

Thus, according to an exemplary embodiment shown in FIGS. 5 through 7, when there are fluctuations from a relatively high gray level to a relatively low gray level and then from the relatively low gray level to another relatively high gray level, a third primitive image signal is corrected based on a corrected image signal by compensating for a second converted image signal into which a second primitive image signal is converted, based on a response speed of liquid crystal molecules. Therefore, a display quality of an image displayed in response to a current corrected image signal corresponding to a current frame is substantially improved.

Figure 8:
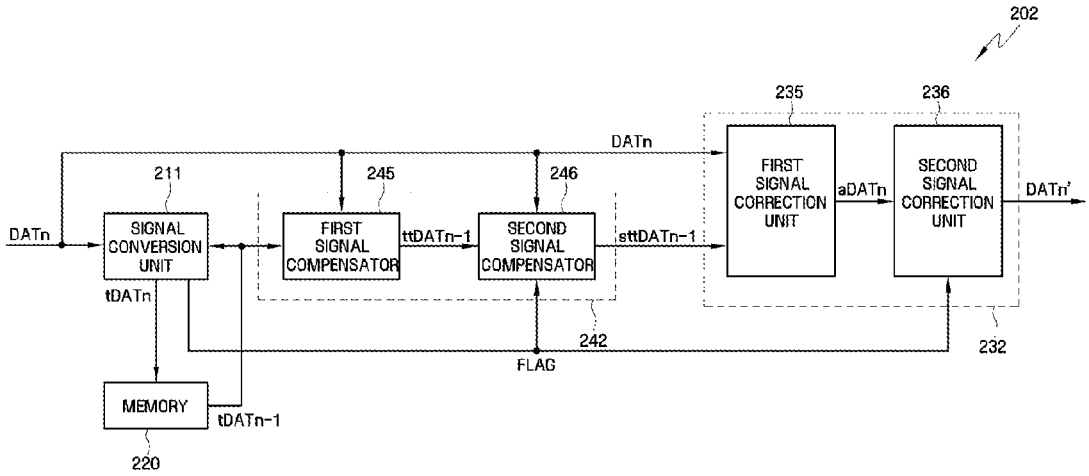
FIG. 8 is a block diagram of an exemplary embodiment of a timing controller of an LCD according to the present invention.

An LCD and a method of driving the LCD according to an exemplary embodiment will now be described in further detail with reference to FIGS. 8 through 10. FIG. 8 is a block diagram of an exemplary embodiment of a timing controller 202 of an LCD according to the present invention, FIG. 9 is a signal timing diagram for explaining an exemplary embodiment of an operation of the timing controller 202, and FIG. 10 is an exemplary embodiment of a lookup table utilized by a first signal compensator 245 of the timing controller 202 shown in FIG. 9.

Figure 9:
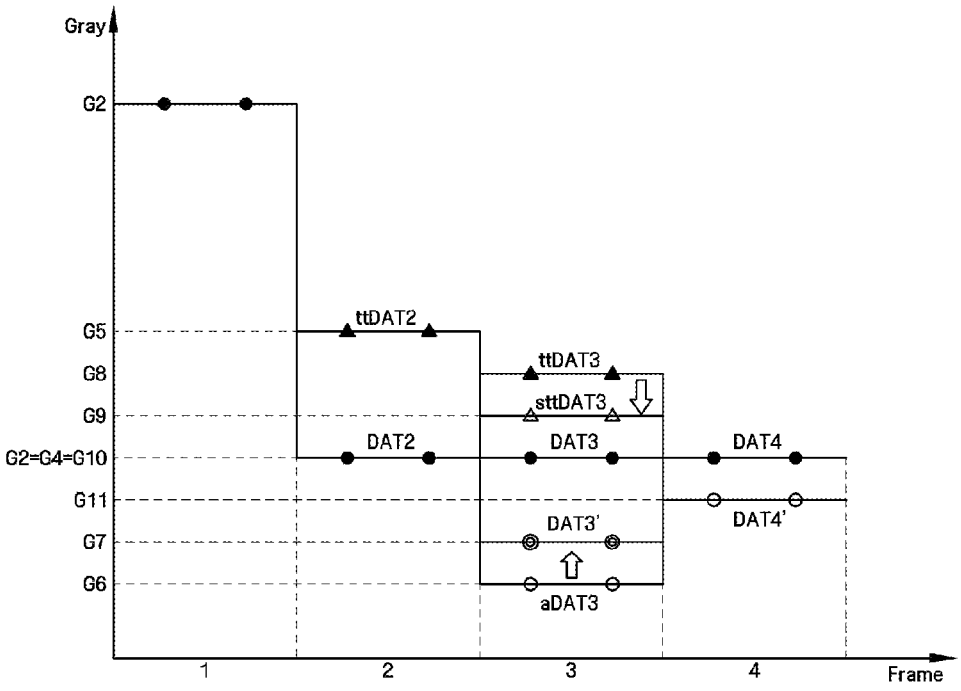
FIG. 9 is a signal timing diagram which illustrates an exemplary embodiment of an operation of the timing controller shown in FIG. 8.

The exemplary embodiment shown in FIGS. 8 through 10 is different from the exemplary embodiments described above in that a third corrected image signal is corrected based on a gray level of a compensated image signal and a gray level of a third primitive image signal. Referring to FIGS. 8 and 9, the timing controller 202 according to an exemplary embodiment includes a signal conversion unit 211, a memory 220, a signal compensation unit 242 and a signal correction unit 232.

The signal conversion unit 211 may generates a current conversion image signal tDATn corresponding to a current frame based on a gray level corresponding to an image signal pair including a current primitive image signal DATn corresponding to the current frame and a previous converted image signal tDATn−1 corresponding to a previous frame. The current primitive image signal DATn may be provided by an external source (not shown), and the previous converted image signal tDATn−1 may be provided from the memory 220. The current converted image signal tDATn is stored in the memory 220 for one frame, for example, and is then transmitted to the signal conversion unit 211 and the signal compensation unit 242 as another previous converted image signal.

When the gray level of the current primitive image signal DATn is lower than the gray level of the previous primitive image signal DATn−1, a difference between the gray level of the current primitive image signal DATn and the gray level of the previous primitive image signal DATn−1 is greater than a first reference value, and a difference between the gray level of the current primitive image signal DATn and the gray level of the previous converted image signal tDATn−1 is greater than a second reference value, the signal conversion unit 211 transmits a conversion flag signal FLAG to the signal compensation unit 242 and the signal correction unit 232.

The signal compensation unit 242 according to an exemplary embodiment includes a first signal compensator 245 and a second signal compensator 245.

The first signal compensator 245 receives the previous converted image signal tDATn−1 from the memory 220, and generates a previous initial compensated image signal ttDATn−1 based on the previous converted image signal tDATn−1.

The second signal compensator 246 generates a previous recompensated image signal sttDATn−1 using the previous initial compensated image signal ttDATn−1 based on a signal of the conversion flag signal FLAG and the current primitive image signal DATn. When the conversion flag signal FLAG is an on-signal having a first level and the difference between the gray level of the previous converted image signal tDATN−1 and the gray level of the current primitive image signal DATn is greater than a reference value, the second signal compensator 246 generates the previous recompensated image signal sttDATn−1.

The previous initial compensated image signal ttDATn−1 is stored in the memory 220 for one frame, for example, and is then be provided to the first signal compensator 245. The previous initial compensated image signal ttDATn−1 corresponds to the previous converted image signal tDATn−1, and thus, the conversion flag signal FLAG corresponds to the previous frame, e.g., an (n−1)th frame.

Thus, the second signal compensator 246 generates the previous recompensated image signal sttDATn−1 based on the previous initial compensated image signal ttDATn−1 when the conversion flag signal FLAG has the first level and the gray level of the current primitive image signal DATn is lower than the gray level of the previous conversion image signal tDATn−1 and the reference gray level. The second signal compensator 246 provides the previous recompensated image signal sttDATn−1 to the first signal corrector 235.

In an exemplary embodiment, generation of the previous recompensated image signal sttDATn−1 based on the previous initial compensated image signal ttDATn−1 is performed using Compensation Formula (3):

$$G9=G2+(G8-G2)\times C(0\leq C\leq 1) \qquad \text{Compensation Formula (3).}$$

The signal correction unit 232 according to an exemplary embodiment includes a first signal corrector 235 and a second signal corrector 236.

The first signal corrector 235 receives the previous recompensated image signal sttDATn−1 and generates an initial corrected image signal aDATn corresponding to the current frame based on the current primitive image signal DATn. The first signal corrector 235 transmits the initial corrected image signal aDATn to the second signal corrector 236.

The second signal corrector 236 generates a recorrected (e.g., twice corrected) image signal DATn' using the initial corrected image signal aDATn based on the conversion flag signal FLAG and the current primitive image signal DATn. When the conversion flag signal is an on-signal having the first level and the gray level of the current primitive image signal DATn is lower than the gray level of the previous converted image signal tDATn−1, the second signal corrector 236 generates the recorrected image signal DATn'.

In an exemplary embodiment, generation of the recorrected image signal DATn' based on the initial corrected image signal aDATn may be performed using Compensation Formula (4):

$$G7=G4+(G6-G4)\times D(0\leq D\leq 1) \qquad \text{Compensation Formula (4).}$$

Referring now to FIG. 8, the second signal corrector 236 receives the previous recompensated image signal sttDATn−1 from the second signal compensator 246, and generates the recorrected image signal DATn' based on the previous recompensated image signal sttDATn−1 and the previous initial corrected image signal sttDATn−1. The second signal corrector 236 generates the recorrected image signal DATn' when the conversion flag signal FLAG is an on-signal having the first level and the gray level of the current primitive image signal DATn is lower than the gray level of the previous converted image signal tDATn−1 and a reference gray level.

Referring to FIG. 9, a first primitive image signal DAT, a second primitive image signal DAT2, a third primitive image signal DAT3 and a fourth primitive image signal DAT3 correspond to four consecutive frames, e.g., to a first frame through a fourth frame. The second, third and fourth primitive image signals DAT2, DAT3 and DAT4, respectively, a second gray level G2, a fourth gray level G4 and a tenth gray level G10, respectively. When the second gray level G2 is lower than a first gray level G1 and a difference between the third gray level G3 and the first gray level G1 is greater than a first reference value, the signal conversion unit 211 generates the second converted image signal tDATn2 based on the second primitive image signal DAT2 having the second gray level G2. The signal conversion unit 211 provides a conversion flag signal FLAG having a first level to the signal compensation unit 242 and the signal correction unit 232. The second gray level G2, the fourth gray level G4 and the tenth gray level G10 are illustrated in FIG. 9 as being substantially the same, but exemplary embodiments are not limited thereto. For example, the third gray level G3, the fourth gray level G4 and the tenth gray level G10 may be different from one another. In this case, the fourth gray level G4 may be lower than a reference gray level.

An operation of the first signal compensator 245 is substantially the same as the operation of the signal compensation unit 241 described in greater detail above with reference to FIG. 5. For example, the first signal compensator 245 generates the second compensated image signal ttDAT2 having a fifth gray level G5 based on the second converted image signal tDAT2 having the third gray level G3 based on the third primitive image signal DAT3 having the fourth gray level G4.

The first signal corrector 235 generates the initial corrected image signal aDAT3 having a sixth gray level G6 by correcting the third primitive image signal DAT3 having the fourth gray level G4 using the second compensated image signal ttDAT2 having the fifth gray level G5. The second signal corrector 236 generates the recorrected image signal DAT3' having a seventh gray level G7 by correcting the initial corrected image signal aDAT3 with reference to the level of the conversion flag signal FLAG and a difference between the gray level of the second compensated image signal ttDAT2 and the gray level of the third primitive image signal DAT3.

Likewise, the first signal corrector 235 generates a third initial compensated image signal ttDAT3 having an eighth gray level G8 based on a third converted image signal (not shown) corresponding to the third primitive image signal DAT3. When the conversion flag signal FLAG has the first level and the difference between the gray level of the third primitive image signal DAT3 and the gray level of the second converted image signal tDAT2, e.g., the difference between the fourth gray level G4 and the third gray level G3, is greater than a reference value, the second signal compensator 246 generates the third recompensated image signal sttDAT3 having a ninth gray level G9 by correcting the third initial compensated image signal ttDAT3 having the eighth gray level G8.

The third recompensated image signal sttDAT3 having the ninth gray level G9 is provided to the first signal corrector 235. The first signal corrector 235 generates a fourth corrected image signal DAT4' by correcting the fourth primitive image signal DAT4 having the tenth gray level G10 based on the third recompensated image signal sttDAT3. Thus, the fourth corrected image signal DAT4' may be directly output to a liquid crystal panel (not shown) without a requirement to be transmitted to the second signal corrector 236.

Thus, according to an exemplary embodiment shown FIGS. 8 through 10, an image displayed on a liquid crystal panel is stabilized by generating a recompensated image signal with the second signal compensator 246 and generating a recorrected image signal with the second signal corrector 236. Therefore, a display quality is substantially improved.

Figure 11:
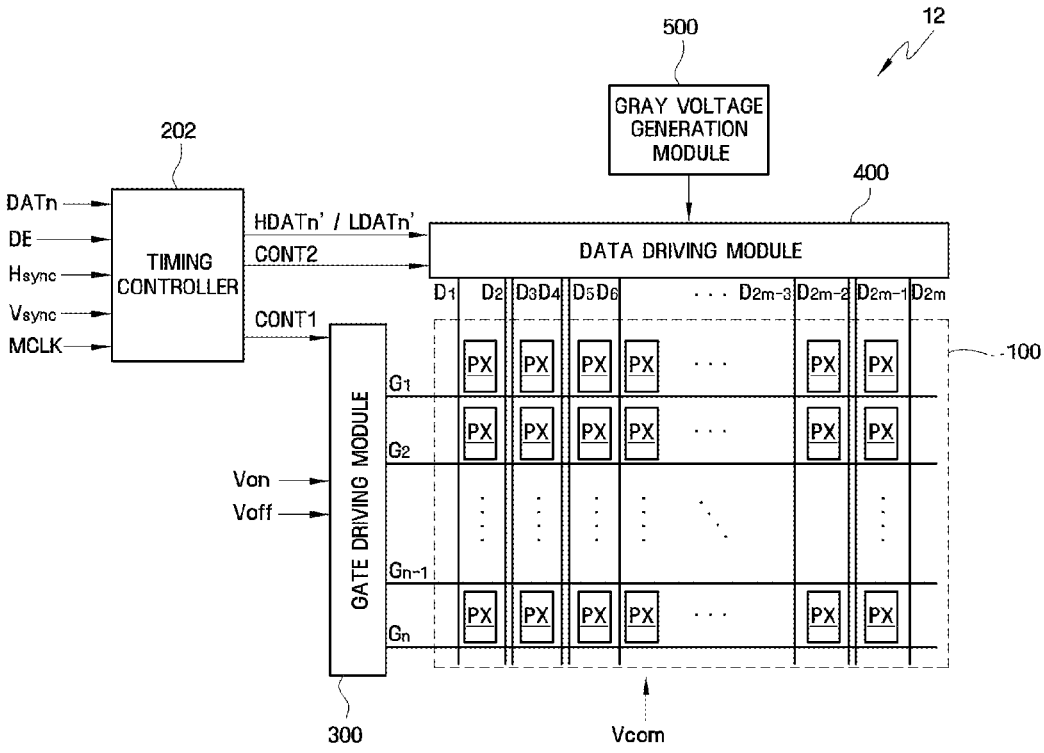
FIG. 11 is a block diagram of an exemplary embodiment of an LCD according to the present invention.

An LCD and a method of driving the LCD, according to other exemplary embodiments of the present invention will hereinafter be described in detail with reference to FIGS. 11 through 13. FIG. 11 is a block diagram of an exemplary embodiment of an LCD 12 according to the present invention, FIG. 12 is an equivalent circuit diagram of an exemplary embodiment of a pixel PX of the LCD 12, and FIG. 13 is a block diagram of an exemplary embodiment of a timing controller 203 of the LCD 12 shown in FIG. 11.

Figure 12:
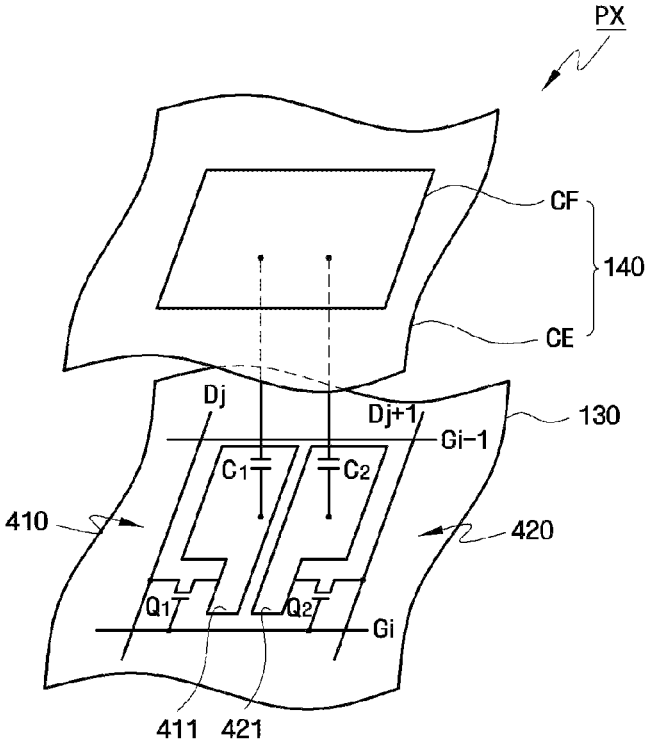
FIG. 12 is an equivalent circuit diagram of a an exemplary embodiment of a pixel of the LCD shown in FIG. 11.
Figure 13:
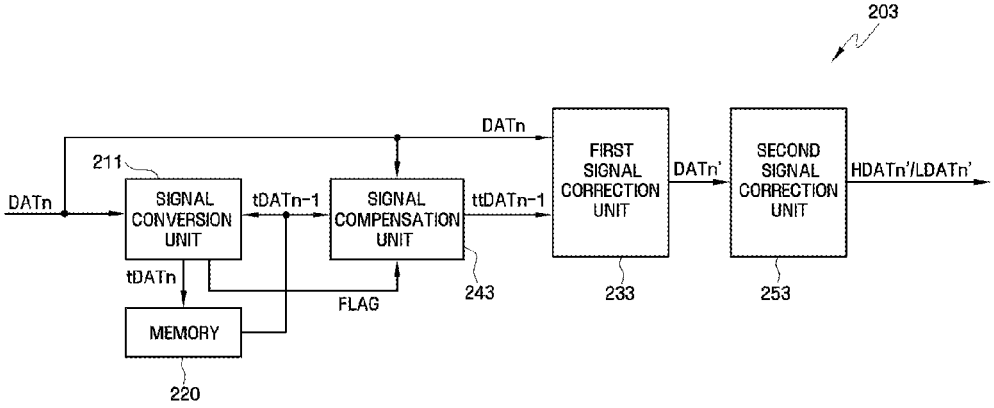
FIG. 13 is a block diagram of an exemplary embodiment of a timing controller of the LCD shown in FIG. 11.

The exemplary embodiment shown in FIGS. 11 through 13 is different from the exemplary embodiments described in greater detail above in that the timing controller 203 includes a second signal correction unit 252 which generates a first sub-image signal and a second sub-image signal based on a corrected image signal. The exemplary embodiment shown FIGS. 11 through 13 will now be described in further detail.

Referring now to FIG. 11, the LCD 12 according to an exemplary embodiment includes a liquid crystal panel 100, a gate driving module 300, a data driving module 400 and the timing controller 203.

The liquid crystal panel 100 includes pixels PX, gate lines $G_1$ through $G_n$ and data lines $D_1$ through $D_{2m}$.

A gate-on voltage Von and a gate-off voltage Voff, provided by the gate driving module 300, may be applied to the gate lines $G_1$ through $G_n$. A data voltage, provided by the data driving module 400, may be applied to the data lines $D_1$ through $D_{2m}$. The gate lines $G_1$ through $G_n$ extend a substantially row direction and in parallel with one another, and the data lines $D_1$ through $D_{2m}$ extend in a substantially column direction and in parallel with one another. Two data lines may be provided for each column of pixels PX, as shown in FIG. 11.

Referring to FIG. 12, the pixel PX, connected to an i-th gate line Gi and first and second data lines Dj and Dj+1, includes a first sub-pixels 410 and a second sub-pixel 420. The first sub-pixel 410 and the second sub-pixel 420 may be disposed between a first substrate 130, on which a first pixel electrode 411 and a second pixel electrode 421 are disposed and a second substrate 140, on which a common electrode CE and a color filter CF are disposed.

A first data voltage and a second data voltage may be applied to the pixel PX. More particularly, the first data voltage may correspond to a first sub-image signal HDATn' provided by the timing controller 203, and the second data voltage may correspond to a second sub-image signal LDATn' provided by the timing controller 203. In an exemplary embodiment, a level of the first data voltage may be higher than a level of the second data voltage.

The first sub-pixel 410 may include a first switching device $Q_1$ for providing the first data voltage by being enabled by the gate-on voltage Von and a first capacitor $C_1$ charged with the first data voltage. The second sub-pixel 420 may include a second switching device $Q_2$ for providing the second data voltage by being enabled by the gate-on voltage Von and a second capacitor $C_2$ charged with the second data voltage.

In an exemplary embodiments, structures of the first pixel electrode 411 and the second pixel electrode 421 are not restricted to as shown in FIG. 12.

Referring again to FIG. 11, the timing controller 203 according to an exemplary embodiment receives a primitive image signal DATn and outputs the first sub-image signals HDATn' and the second sub-image signal LDATn'. The first sub-image signal HDATn' and the second sub-image signal LDATn' may be obtained by correcting a current corrected image signal DATn' corresponding to a current frame, e.g., an nth frame. The current corrected image signal DATn' may be obtained by correcting a current primitive image signal DATn corresponding to the current frame. A structure and operation of the timing controller 203 according to an exemplary embodiment will now be described in detail with reference to FIG. 13.

As shown in FIG. 13, the timing controller 203 includes a signal conversion unit 211, a signal compensation unit 243, a memory 220, a first signal correction unit 233 and the second signal correction unit 253. The signal conversion unit 211, the signal compensation unit 243, the memory 220 and the first signal correction unit 233 may be substantially the same as their respective counterparts described in greater detail above and shown in FIGS. 3, 5 and/or 8. Thus, any repetitive detailed description thereof will hereinafter be omitted.

In an exemplary embodiment, the second signal correction unit 253 receives the current corrected image signal DATn' from the first signal correction unit 233 and generates the first sub-image signal HDATn' having a higher gray level than a gray level of the current corrected image signal DATn' and the second sub-image signal LDATn' having a lower gray level than a gray level of the current corrected image signal DATn' based on the current corrected image signal DATn'. The second signal correction unit 253 may perform ACC to substantially improve color properties, for example, of the current corrected image signal DATn'.

Thus, according to an exemplary embodiment shown in FIGS. 11 through 13, a display quality of a liquid crystal panel is substantially improved by compensating for a gray level of an image signal based on a response speed of liquid crystal molecules. In addition, color properties of an image signal are substantially improved by dividing the image signal into first and second sub-image signals.

The present invention should not be construed as being limited to the exemplary embodiments set forth herein. Rather, these exemplary embodiments are provided so that this disclosure will be thorough and complete and will fully convey the concept of the present invention to those skilled in the art. It will therefore be noted that the exemplary embodiments described herein shall be considered in all respects as illustrative and not restrictive.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A liquid crystal display comprising:

a timing controller which sequentially receives a first primitive image signal, a second primitive image signal and a third primitive image signal and sequentially outputs a first corrected image signal, a second corrected image signal and a third corrected image signal; and a data driving module outputs an image data voltage corresponding to the first corrected image signal, the second corrected image signal and the third corrected image signal, respectively, wherein the timing controller generates a first converted image signal having a first gray level based on the first primitive image signal, the timing controller stores the first converted image signal, and the second primitive image signal has a second gray level and the timing controller generates a second converted image signal having a third gray level higher than the second gray level when the second gray level is lower than the first gray level, wherein the timing controller generates an initial compensated image signal having a fifth gray level lower than the third gray level based on the second converted image signal and generates the third corrected image signal using the initial compensated image signal and the third primitive image signal.

2. The liquid crystal display of claim 1, wherein each of the first primitive image signal, the second primitive image signal and the third primitive image signal includes a first sub-image signal having a gray level higher than the gray level of a corresponding one of the first corrected image signal, the second corrected image signal and the third corrected image signal.

3. The liquid crystal display of claim 2, wherein the image data voltage comprises a first data voltage which corresponds to the first sub-image signal and a second data voltage which corresponds to the second sub-image signal, and a level of the first data voltage higher than a level of the second data voltage.

4. The liquid crystal display of claim 1, wherein: the first gray level is higher than a reference gray level; and the second gray level is lower than the reference gray level.

5. The liquid crystal display of claim 4, wherein: the third primitive image signal has a fourth gray level; and the second gray level is lower than the fourth gray level.

6. The liquid crystal display of claim 1, wherein the third primitive image signal has a fourth gray level.

7. The liquid crystal display of claim 6, wherein, when the fourth gray level is lower than the third gray level, the timing controller generates the third corrected image signal by generating a recompensated image signal having a sixth gray level lower than the fifth gray level based on the initial compensated image signal and correcting the third primitive image signal using the recompensated image signal.

8. The liquid crystal display of claim 6, wherein, when the fourth gray level is lower than the third gray level, the timing controller generates the third corrected image signal by generating an initial corrected image signal using the initial compensated image signal and the third primitive image signal and recorrecting the initial corrected image signal using the second primitive image signal.

9. The liquid crystal display of claim 6, wherein when the fourth gray level is higher than a reference gray level, the timing controller generates the initial compensated image signal using a first compensation formula and when the fourth gray level is lower than the reference gray level, the timing controller generates the initial compensated image signal using a second compensation formula different from the first compensation formula.

10. The liquid crystal display of claim 1, wherein the timing controller comprises a lookup table having gray levels corresponding to an image signal pair including the first converted image signal and the second primitive image signal, and the timing controller generates the second converted image signal based on the fourth gray level by using the lookup table.

11. The liquid crystal display of claim 10, wherein each of the gray levels included in the lookup table is an experimental value obtained by measuring a gray level of liquid crystal for one frame upon a transition from the first converted image signal to the second primitive image signal.

12. A method of driving a liquid crystal display, the method comprising:

receiving a first primitive image signal, a second primitive image signal and a third primitive image signal;

outputting a first corrected image signal, a second corrected image signal and a third corrected image signal; and outputting an image data voltage corresponds to the first corrected image signal, the second corrected image signal and the third corrected image signal, respectively, wherein the outputting the first corrected image signal, the second corrected image signal and the third corrected image signal comprises:

generating a first converted image signal having a first gray level based on the first primitive image signal;

storing the first converted image signal; generating, when the second primitive image signal has a second gray level lower than the first gray level, a second converted image signal having a third gray level higher than the second gray level;

after the generating of the second converted image signal, generating an initial compensated image signal having a fifth gray level lower than the third gray level based on the second converted image signal;

generating the third corrected image signal using the second converted image signal and the third primitive image signal; and outputting the third corrected image signal, wherein the generating of the third corrected image signal comprises generating the third corrected image signal using the initial compensated image signal and the third primitive image signal.

13. The liquid crystal display of claim 12, wherein each of the first primitive image signal, the second primitive image signal and the third primitive image signal includes a first sub-image signal having a gray level higher than the gray level of a corresponding one of the first corrected image signal, the second corrected image signal and the third corrected image signal.

14. The liquid crystal display of claim 13, wherein the image data voltage comprises a first data voltage which corresponds to the first sub-image signal and a second data voltage which corresponds to the second sub-image signal, and a level of the first data voltage higher than a level of the second data voltage.

15. The method of claim 12, wherein: the first gray level is higher than a reference gray level; and the second gray level is lower than the reference gray level.

16. The method of claim 12, wherein the third primitive image signal has a fourth gray level.

17. The method of claim 16, wherein, when the fourth gray level is lower than the third gray level, the generating of the third corrected image signal comprises: generating a recompensated image signal having a sixth gray level lower than the fifth gray level based on the initial compensated image signal; and correcting the third primitive image signal using the recompensated image signal.

18. The method of claim 16, wherein, when the fourth gray level is lower than the third gray level, the generating of the third corrected image signal comprises: generating a third initial corrected image signal using the initial compensated image signal and the third primitive image signal; and correcting the third initial corrected image signal using the second primitive image signal.

19. The method of claim 16, wherein when the fourth gray level is higher than a reference gray level, the generating of the initial compensated image signal comprises using a first compensation formula, and when the fourth gray level is lower than the reference gray level, the generating of the initial compensated image signal comprises using a second compensation formula different from the first compensation formula.

20. The method of claim 12, wherein the generating the second converted image signal comprises using a lookup table having gray levels for an image signal pair including the first converted image signal and the second primitive image signal.

* * * * *